United States Patent [19]

Thomas

[11] 4,440,180

[45] Apr. 3, 1984

[54] CURL LIFTING COMB OR PICK

[76] Inventor: Rodney E. Thomas, 3271 Desert Cir., Apt. #1, East Point, Fulton County, Ga. 30344

[21] Appl. No.: 406,084

[22] Filed: Aug. 6, 1982

[51] Int. Cl.[3] ..... A45D 24/00

[52] U.S. Cl. ..... 132/11 R; 132/129

[58] Field of Search ..... 132/11 R, 46 R, 48 R, 132/45 R, 129

[56] References Cited

U.S. PATENT DOCUMENTS

| | | | |
|---|---|---|---|
| 1,042,940 | 10/1912 | McConnell | 132/134 |
| 1,286,823 | 12/1918 | Stahle | 132/129 |
| 1,708,379 | 4/1929 | David | 132/134 |
| 2,241,879 | 5/1941 | Foster, Jr. | 132/135 |
| 2,638,100 | 5/1953 | Lazicki | 132/134 |
| 3,073,318 | 1/1963 | Catania | 132/46 R |
| 4,008,726 | 2/1977 | DiGiuseppe | 132/11 R |

*Primary Examiner*—Gregory E. McNeill

*Attorney, Agent, or Firm*—Newton, Hopkins & Ormsby

[57] ABSTRACT

A pair of cooperative comb members are pivotally connected and resiliently biased so that the tines of the two members occupy a common plane. In response to drawing together two handle extensions of the comb members, their respective tines separate to lift and fluff the curls on the head of the user of the device.

7 Claims, 5 Drawing Figures

CURL LIFTING COMB OR PICK

BACKGROUND OF THE INVENTION

The simple object of this invention is to satisfy a need for a more convenient and effective device for lifting, separating and fluffing curls on the head of a user of the device. Heretofore, the lifting and fluffing of curls has been achieved in a rather inconvenient and sometimes laborious manner by the use of conventional picks or combs. The present invention seeks to simplify the curl lifting operation, to shorten the time required to achieve the desired results, and to act on the curls in a much more efficient manner so as to provide a more desirable appearance for the hair when treated by the invention.

Other features and advantages of the invention will become apparent to those skilled in the art during the course of the followed detailed description.

DETAILED DESCRIPTION

Figure 1:
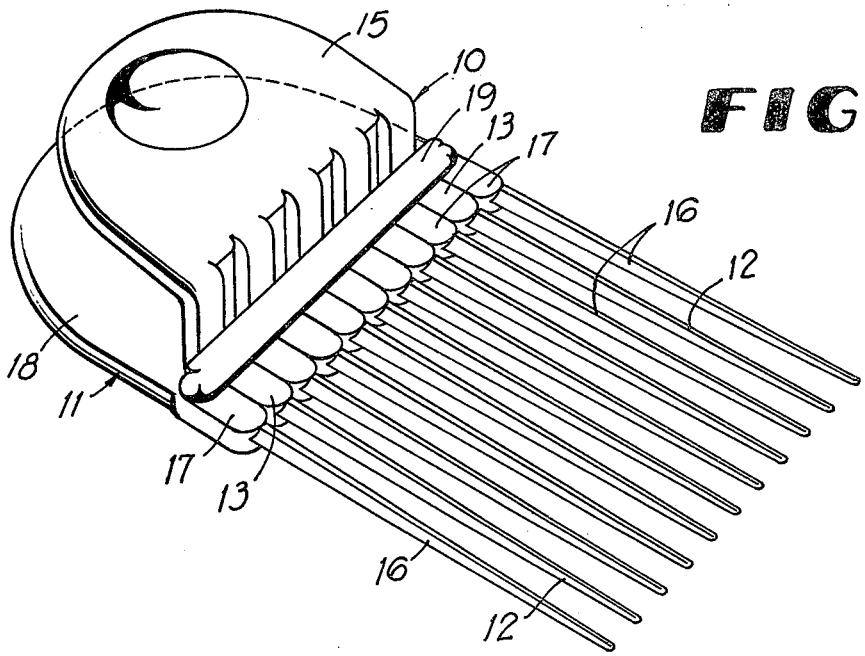
FIG. 1 is a perspective view of a curl lifting comb or pick according to the present invention in its normally biased condition.
Figure 5:
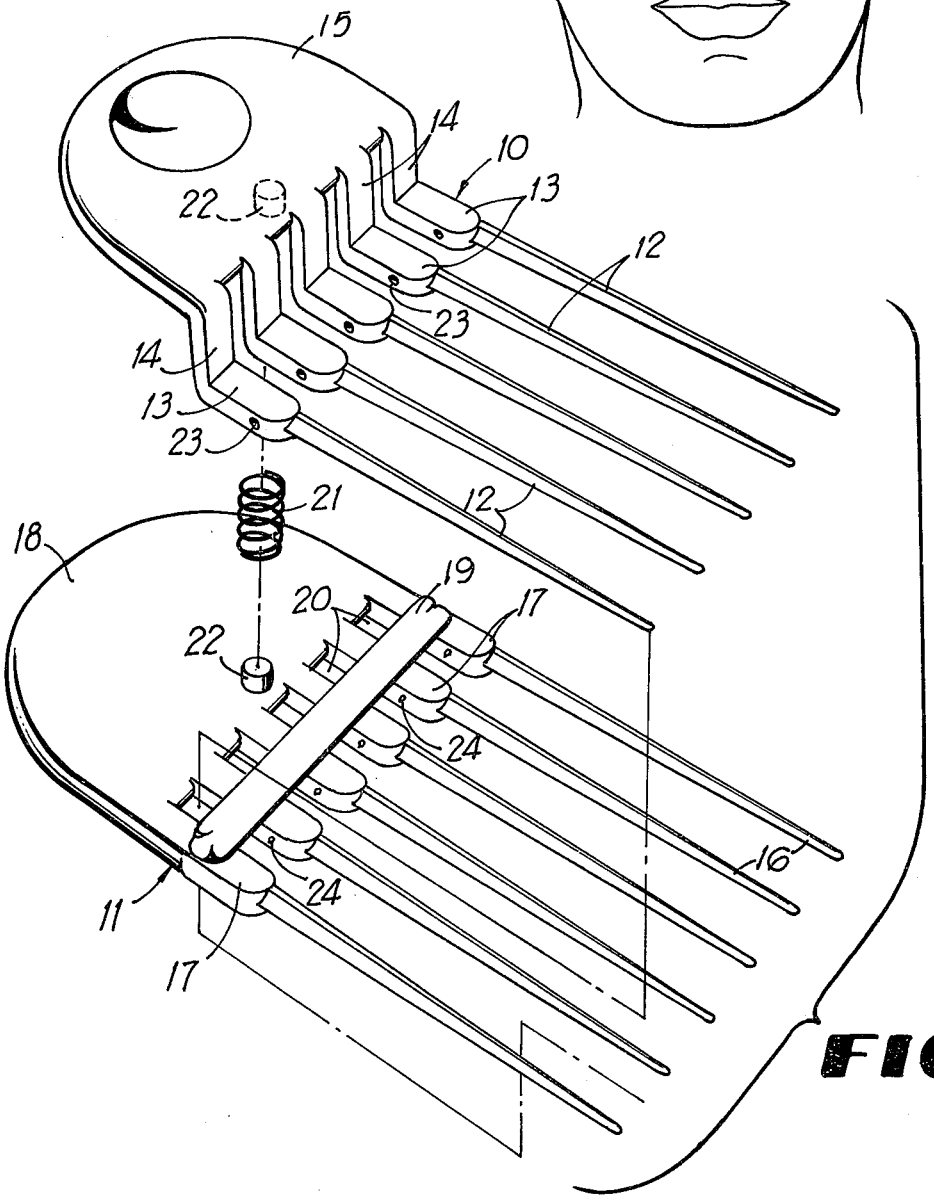
FIG. 5 is an exploded perspective view of the comb or pick.

Referring to the drawings in detail wherein like numerals designate like parts, a curl lifting, separating and fluffing device consists of two cooperative comb sections or picks 10 and 11 shown in assembled relationship in FIG. 1 and shown separated in FIG. 5.

The comb section 10 includes a plurality of elongated substantially parallel tapered equal length tines 12, whose rear ends are firmly anchored to a corresponding number of short spaced parallel support lugs 13. The lugs 13 are attached to the lower ends of a corresponding number of substantially right angular arms 14, in turn integrally attached to a plate-like manipulating handle 15 for the comb section 10. The handle 15 is offset from the common plane occupied by the tines 12, and the handle is in a plane generally parallel to the plane of the tines or teeth 12.

The cooperative comb or pick section 11 includes a plurality of spaced elongated teeth 16 which are substantially identical to the teeth 12 and have a similar spacing to allow close interfitting with the teeth 12 when the device is assembled. In the illustrated embodiment, the number of teeth 16 exceeds the number of teeth 12 by one. The numbers of the teeth 12 and 16 can be varied, and the illustrated arrangement has proven to be convenient and practical.

The teeth 16 are firmly anchored at their rear ends to spaced lugs 17 integrally attached to and extending forwardly of a plate-like handle 18 which is similar to the handle 15. The teeth 16, spaced lugs 17 and handle 18 occupy a common plane, as shown.

A stop bar 19, whose purpose will be described, extends across the lugs 17 at right angles thereto and near their longitudinal centers. This stop bar is fixed to the lugs 17 and forms therewith a series of apertures 20 between the rear side of the bar 19 and the handle 18.

A biasing spring 21 for the two sections 10 and 11 is provided and in the assembled device this spring extends between the handles 15 and 18 and is positioned by a pair of locator pins 22 fixed to the opposing faces of the handles near the forward ends of the handles and preferably at their transverse centers. The spring 21 lies rearwardly of the transverse pivot axis for the two sections 10 and 11, yet to be described.

This pivot axis is defined by a series of transversely aligned female and male snap detents 23 and 24 provided on corresponding side faces of the lugs 13 and 17 somewhat forwardly of the stop bar 19. Typically, the detent elements 23 and 24 are female and male hemispherical elements which can be snapped together releasably to form a transverse axis pivotal connection for the two comb or pick sections 10 and 11.

To assemble the device, the teeth 12 of comb section 10 are inserted downwardly through the apertures 20 and the lugs 13 are then received in the slots between the lugs 17 of comb section 11. The detents 23 and 24 can then be snapped together due to the inherent resiliency of the parts which are typically molded from a suitable plastics material. The biasing spring 21 is engaged over the locator pins 22 and serves to bias or separate the handles 15 and 18. The stop bar 19, which is now above and across the lugs 13, limits the pivotal biasing of the handle 15 relative to the handle 18.

The normal assembled state of the device under the biasing influence of the spring 21 is shown in FIG. 1 of the drawings. The teeth or tines 12 and 16 are in close fitting side-by-side relationship and occupy a common plane. The lugs 13 and 17 are also in side-by-side relationship in this plane and the opposing handles 15 and 18 are in spaced generally parallel relationship.

Figure 2:
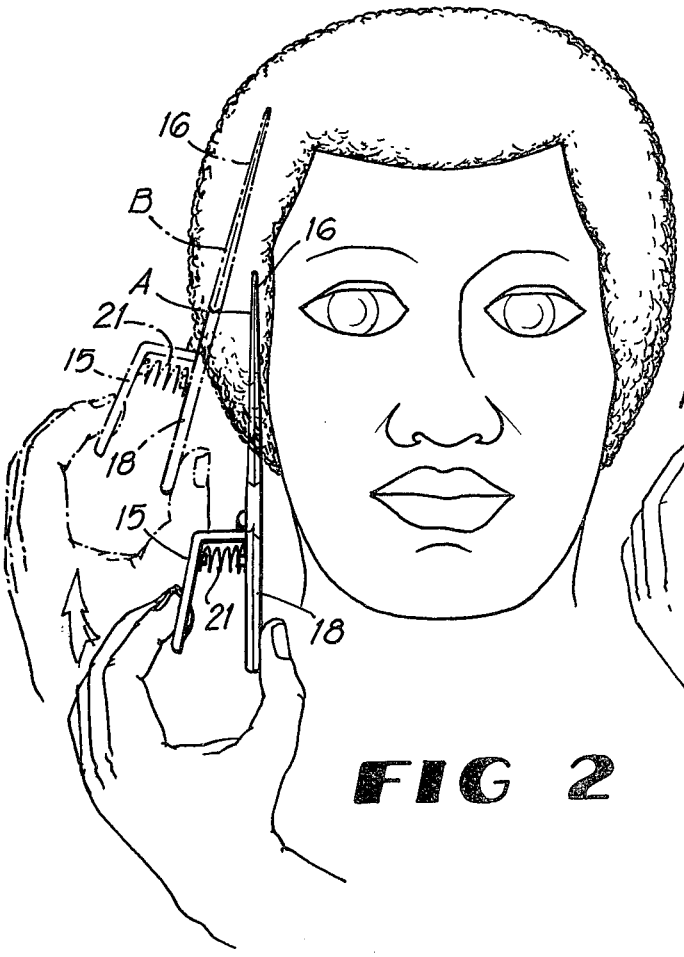
FIGS. 2 and 3 are operational views of the invention showing the procedure for lifting or fluffing curls on the head.
Figure 3:
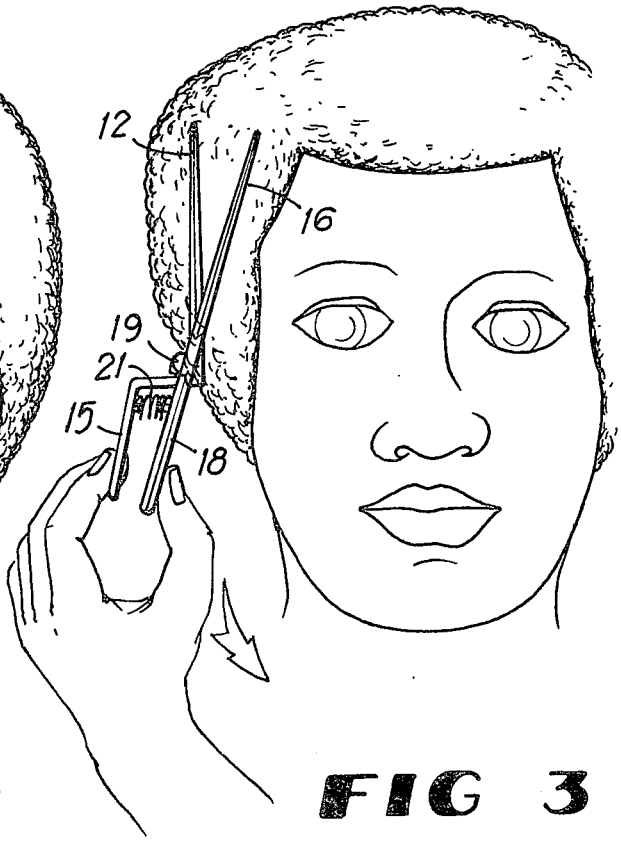
Figure 4:
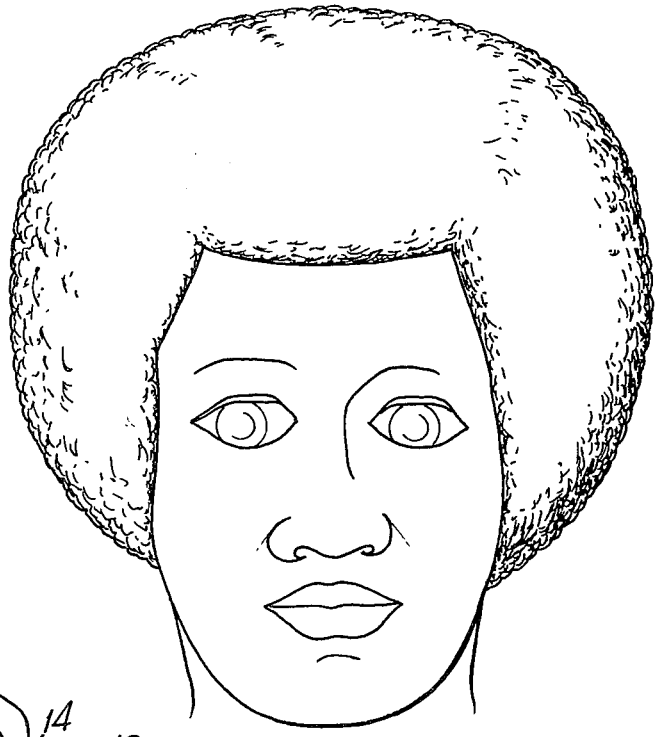
FIG. 4 is a front elevational view showing the head of a user of the device and depicting the outstanding results obtained.

The use of the invention is clearly shown in FIGS. 2 and 3, and the superior results obtained are shown in FIG. 4. Referring to FIG. 2, with the device in its normally biased state shown in FIG. 1, the tines 12 and 16 are inserted deeply into the hair at any desired location on the head, for example the location shown at A in FIG. 2. The device is then manipulated by squeezing together the handles 15 and 18, as depicted in FIG. 3, resulting in separation of the tines or teeth 16 and 12 while they are deeply embedded in the hair and have penetrated through a multitude of curls. In separating, the tines 16 and 12 act on the curls to separate them and to lift them, thereby imparting a beautiful full-bodied fluff to the hair shown in one location in FIG. 3 and shown over the entire head in FIG. 4.

In FIG. 2, a second location of the device with the tines penetrating the hair is shown in phantom lines. The process is repeated at multiple points until the desired result is achieved. Whenever finger pressure on the handles 15 and 18 is relieved, the cooperative tines 12 and 16 return automatically to their side-by-side positions shown in FIGS. 1 and 2. A second location of the device in the hair is indicated at B in FIG. 2.

As suggested by the directional arrows in FIGS. 2 and 3, there is a possible variation in the mode of use of the invention. This variation involves penetrating the hair with the closed tines 12 and 16 at position A, FIG. 2, and then moving the device to position B in a combing action while the tines remain closed. This is then followed at position B by squeezing the handles 15 and 18 and thus separating the tines 12 and 16, as shown in FIG. 3. Then, while the tines 12 and 16 remain separated, the device is pulled downwardly through the hair as shown by the arrow in FIG. 3 until the separated tines exit the hair. A user of the device may create other successful variations in its use after some practice.

As can be seen, use of the invention as described will tend to reduce breakage of the hair strands by reducing tension on the strands while combing the hair. It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A curl treating comb or the like comprising coacting comb sections pivotally connected about an axis, said comb sections having substantially parallel closely interfitting tines on one side of the pivot axis and handle extensions on the other side of said pivot axis, and means resiliently biasing the comb sections to a position where the tines of the comb sections are in an interleaved side-by-side relationship in a common plane, whereby the tines may then penetrate curls and may then be separated to expand the curls by exerting pressure on the handle extension, and a stop element on one comb section to limit relative pivotal movement of the comb sections under influence of the biasing means.

2. A curl treating comb or the like as defined in claim 1, and the biasing means comprising an expansible spring positioned between the handle extensions, one handle extension being offset laterally from the plane occupied by the tines of the comb section having the offset handle extension.

3. A curl treating comb or the like as defined in claim 1, and the tines of said comb sections comprising slender substantially straight elongated equidistantly spaced forwardly tapering tines of substantially equal lengths.

4. A curl treating comb or the like as defined in claim 1, and the pivot axis of the comb sections being aligned substantially transversely of said tines.

5. A curl treating comb or the like as defined in claim 4, and a stop element comprising a fixed stop bar attached to one comb section across the longitudinal axes of the tines of said comb section and being spaced from and parallel to said pivot axis to limit relative pivotal movement of the comb sections under influence of the biasing means.

6. A curl treating comb or the like as defined in claim 1, and the pivotal connection between the comb sections comprising interfitting detent elements on corresponding sides of the tines adapted to be snapped into and out of cooperative engagement when the comb sections are assembled and disassembled, said detent elements being aligned across the longitudinal axes of the tines.

7. A curl treating comb or the like comprising coacting comb sections pivotally connected about an axis, said comb sections having substantially parallel closely interfitting tines on one side of the pivot axis and handle extensions on the other side of said pivot axis, means resiliently biasing the comb sections to a position where the tines of the comb sections are in side-by-side relationship in a common plane, whereby the tines may then penetrate curls and may then be separated to expand the curls by exerting pressure on the handle extensions, a stop bar to limit relative pivotal motion of the comb sections in one direction under influence of said biasing means fixed across the longitudinal axes of the tines of one comb section on one side of said pivot axis, the stop bar defining with slots between said tines a series of apertures adapted to receive the tines of the other comb section to facilitate assembling the curl treating comb, and detent means on the comb sections across the longitudinal axes of the tines defining the pivot axis and being aligned transversely of the tines.

* * * * *